US008768604B1

(12) United States Patent
Klimek

(10) Patent No.: US 8,768,604 B1
(45) Date of Patent: Jul. 1, 2014

(54) METHOD AND SYSTEM FOR NORMALIZING AND COMPARING GPS DATA FROM MULTIPLE VEHICLES

(76) Inventor: Tomasz R. Klimek, Alexandria, VA (US)

( * ) Notice: Subject to any disclaimer, the term of this patent is extended or adjusted under 35 U.S.C. 154(b) by 0 days.

(21) Appl. No.: 13/539,355

(22) Filed: Jun. 30, 2012

(51) Int. Cl.
*G08G 1/13* (2006.01)

(52) U.S. Cl.
USPC ..... 701/117; 701/466; 340/988; 340/990; 340/992; 340/995.1

(58) Field of Classification Search
USPC ..... 701/117, 466; 340/988, 990, 992, 995.1
See application file for complete search history.

(56) References Cited

U.S. PATENT DOCUMENTS

2010/0160013 A1* 6/2010 Sanders ..... 463/6
2013/0197679 A1* 8/2013 Balakrishnan et al. ..... 700/91

* cited by examiner

*Primary Examiner* — Mary Cheung
*Assistant Examiner* — Brian P Sweeney

(57) ABSTRACT

A system, method, and computer program product which normalizes GPS data obtained from multiple vehicles. At a server, GPS information is received from first and second vehicles in first and second formats. The GPS data is normalized for synchronized display of positions of the first and second vehicles, and transmitted to a computer in order to display simultaneously the synchronized positions of the first and second vehicles. An end user of the system may search for GPS logs of other people and simultaneously display the information resulting from the search with his or her own GPS information. The system may also provide for an automatic upload from a mobile device of the GPS data captured on a circuit or other location.

20 Claims, 10 Drawing Sheets

900

| 902 | 904 | 906 | 908 | 910 | 912 | 914 | 916 | 918 | 920 |
|---|---|---|---|---|---|---|---|---|---|
| LogID | TimeStamp | Longitude | Latitude | Altitude | Heading | Speed | Lap | LapDist | TotalDist |
| | | | | | | | | | |

FIG. 9A

922

| 924 | 926 | 928 | 930 | 932 | 934 | 936 | 938 | 940 | 942 |
|---|---|---|---|---|---|---|---|---|---|
| LogID | UserID | UserEventID | LocationID | LogName | LogDesc | VehicleID | Share | VideoLink | FileName |
| | | | | | | | | | |

FIG. 9B

942

| 944 | 946 | 948 | 950 | 952 | 954 | 956 |
|---|---|---|---|---|---|---|
| LogID | LapNum | LapStart | LapEnd | LapTime | LapLength | LapTypeID |
| | | | | | | |

FIG. 9C

METHOD AND SYSTEM FOR NORMALIZING AND COMPARING GPS DATA FROM MULTIPLE VEHICLES

BACKGROUND OF THE INVENTION

1. Field of the Invention

The present invention relates to obtaining, processing, and/or displaying GPS and other types of data from multiple sources. The invention further relates to the transfer of data from a GPS receiver to a computer.

2. Discussion of the Background

People who drive on a racetrack while racing or just to develop car control skills and are interested in improving their performance may use commercially available data loggers with GPS capabilities to record what they are doing. Exemplary systems which may be utilized to capture GPS data on a racetrack include the AIM EVO4 along with the GPS 05 GPS monitor, the TraqMate system with a display such as the TraqDash or the TraqMate Classic, a system from the company Racepaq such as the IQ3 or the G2X, and the MyChron 4 from AIM. Further, GPS monitoring at the racetrack can be performed with software or an app downloaded to a mobile phone such as an iPhone or an Android-based phone such as Harry's GPS LapTimer. The disclosure, operation, and structure of each of these devices are incorporated herein by reference.

Software which is available for use with these GPS devices allows a user to view lap times, the path or route of the vehicle and other sampled data after a session on the racetrack. However, looking at just your own data has its limitations and limited usefulness in determining how to drive faster or better.

The company TraqMate has a section of its website called Share and Compare. This website allows the posting of a raw TraqMate GPS log file and/or video so that others can view your GPS data. However, the service has deficiencies in that only raw GPS log files are exchanged, and the Share and Compare website does not allow diverse types of data files to be uploaded, but only files which were generated by a TraqMate system. With so many types of GPS files in existence, the present inventor has determined that it is quite limiting to share data in a single manufacturer's file format. Moreover, by posting the data file on the TraqMate website, the entire raw file becomes available for everybody to use without restriction. Further, complex software executed on the user's computer is necessary to view the downloaded file, something which may not be available in the paddock of a race track.

SUMMARY OF THE INVENTION

Accordingly, one object of the invention is to provide a method and system for processing of GPS data which allows a user to compare GPS data from diverse hardware in different formats. An alternative object is to provide a simple system for obtaining and uploading GPS data from a generic programmable mobile device.

The invention includes a method of communicating which performs receiving, from a first computing device, first data containing GPS information from a first vehicle in a first format, and receiving, from a second computing device, second data containing GPS information from a second vehicle in a second format. There is a processing of at least one of the first and second data to obtain normalized data containing GPS information used for synchronized display of positions of the first vehicle and the second vehicle. This normalized data is transmitted to a display computer for simultaneous and synchronized display of the positions of the first vehicle and the second vehicle.

According to another implementation, there is a method comprising requesting, from a server, information of a specific geographic region to be displayed including a first unique route and time information using GPS data, and also requesting information of the specific geographic region to be displayed including a second unique route and time information using GPS data. There is a receiving of visualization data containing information of both the first unique route and time information, and the second unique route and time information, and a simultaneously displaying a synchronized visualization of the first unique route and the second unique route using the visualization data.

According to yet another implementation, there is a system comprising a first non-transitory computer readable medium and a second non-transitory computer readable medium, the first non-transitory computer readable medium including computer code for causing a mobile computing device to interact with a processing device and which causes the mobile computing device to perform the steps of capturing GPS information from a first vehicle in a first format, and uploading the GPS information from the first vehicle. The second non-transitory computer readable medium includes computer code which causes the processing device to perform the steps of processing the GPS information from the first vehicle in order to display a position of the first vehicle, and transmitting the GPS information from the first vehicle which has been processed to a display computer to display a position of the first vehicle.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 9A illustrates an exemplary data structure utilized to store GPS information;

FIG. 9B illustrates an exemplary data structure utilized to identify events; and FIG. 9C illustrates a data structure used for storing information of each lap for a particular log file.

DETAILED DESCRIPTION

Figure 1:
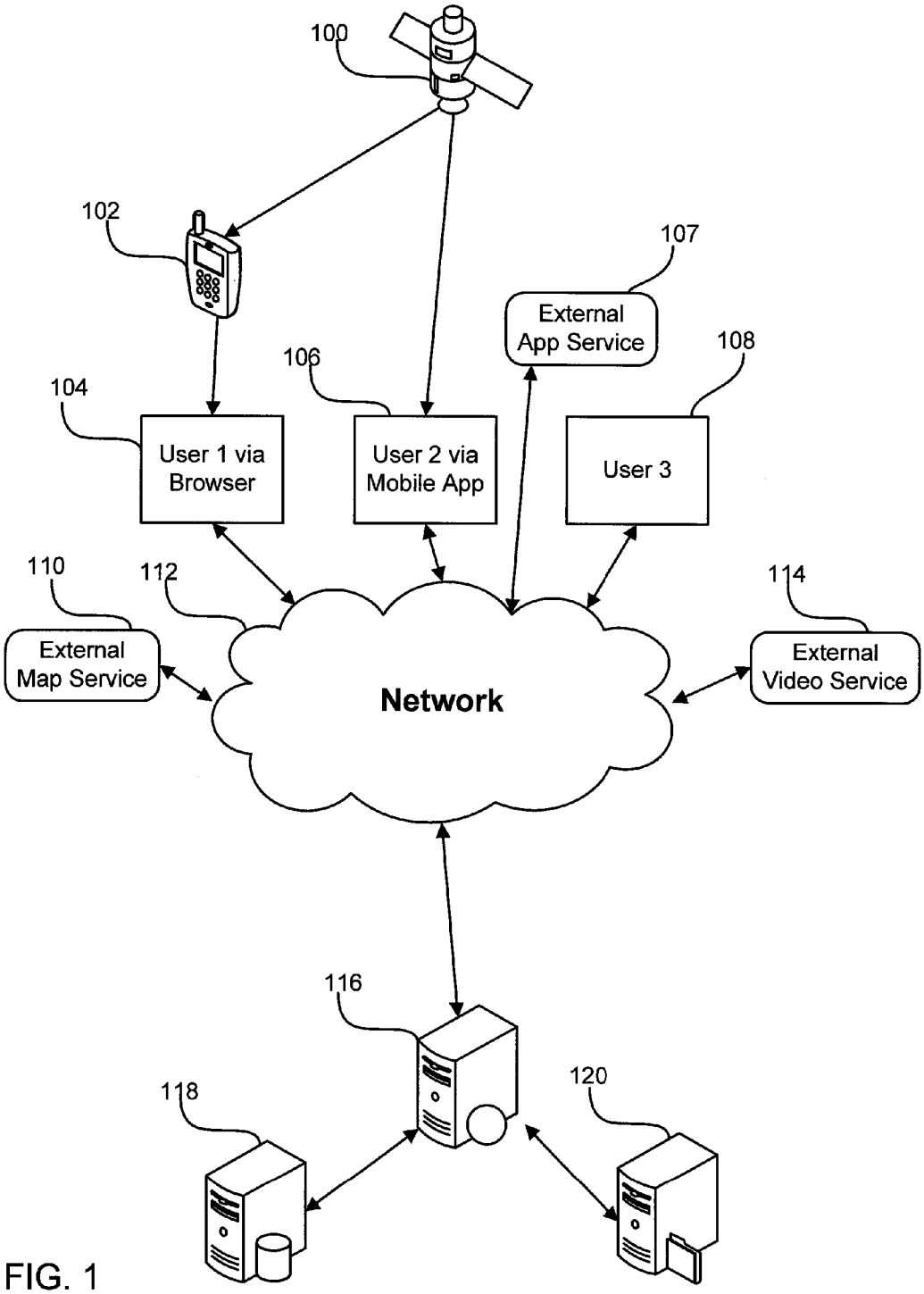
FIG. 1 illustrates a system utilized to implement the invention.

Referring now to the drawings, wherein like reference numerals designate identical or corresponding parts throughout the several views, and more particularly to FIG. 1 thereof, there is illustrated a system utilized with the present invention. In FIG. 1, there is illustrated a satellite 100 which transmits GPS signals to a GPS device 102 and a mobile device 106 labeled as user 2 via mobile app. The mobile device 106 executes a mobile app, app, or software program which is capable of locating a position of the device using the GPS signals from the satellite 100. Only a single satellite 100 has been illustrated in FIG. 1 for purposes of simplicity but it is well known that a GPS system requires multiple satellites in order to appropriately calculate the location of the GPS receiver or GPS antenna.

The GPS device 102 can be any type of device having GPS processing capabilities including readily available commercial devices. The GPS device 102 according to one embodiment is a device specifically constructed for motor vehicle racing applications such as any of the special purpose devices listed in the Background section above, or alternatively a handheld special purpose GPS device such as a Garmin Oregon Series of GPS products, a GPS device which straps onto a user's wrist similar to a watch, or a Megellan GPS device such as the 710, for example. The invention is not limited to any particular brand or style of GPS device but can be utilized with any desired GPS device including GPS devices used with motorcycles, bicycles, boats, or airplanes, for example.

When the GPS and other data is obtained by the GPS device 102, it is sent to a computing device 104 illustrated as a user 1 operating a web browser on a computer. The computer may be a personal computer, portable computer, mobile phone, tablet, or other device. The GPS information may be transferred from the GPS device to the computing device 104 by physically removing a memory card such as an SD card or micro SD card from the GPS device 102 and inserting the memory card into a memory card reader of the computing device 104, by connecting a wire or cable such as a USB cable between the GPS device 102 and computing device 104, or by any other means of transfer or communication including wireless such as Bluetooth or 802.11, or optical communication for example.

The mobile device 106 may be implemented as any type or desired mobile device having the ability to transmit GPS files. For example, the mobile device 106 may be a mobile phone such as an iPhone, an Android based phone, a Windows based phone, or a Blackberry, for example. Moreover, the mobile device 106 may be alternatively or additionally implemented as any type of mobile computing device such as a music playing device with processing capabilities such as an iPod Touch, or a tablet computing device. The mobile device 106 includes a GPS receiver for receiving GPS signals from satellites. Software for implementing the invention may be transferred to the mobile device 106 from an External App Service 107 which may be implemented, for example, like Apple's iTunes Store, or by Google's Play Store. Alternatively, the External App Service 107 may be implemented as a web server or file server, for example. The External App Service 107 may communicate with the mobile device through a network 112, or alternatively through a mobile phone communication network. The connection of the mobile device 106 to the External App Service 107 may be through a wired or wireless network, or a combination thereof.

There is a computing device 108 connected to a network 112 such as the Internet, for example. This computing device may be implemented as a generic personal computer such as a Windows based computer or an Apple computer, or a portable computing device, for example. User 3 will typically operate the web browser in order to access, and play back the GPS data.

The present invention can be used with separate services utilized to generate maps for overlay of the GPS data, such as the external map service 110 which may be implemented, for example, using Google Maps, Bing Maps, a private mapping service, or any other mapping service. Further, there is no need to have an external map service 110, but the mapping utilized by the present invention can be incorporated in any computing device including the web server 116, or other servers discussed below. Similarly, the external video service 114 can be implemented using a commercially available video storage service such as YouTube.com or the video hosting service Vimeo.com, for example. The external video service 114 may be utilized to host and play back video captured by a vehicle or person which is utilizing the GPS device 102 and/or the mobile device 106.

In this writing, a vehicle may be a motor vehicle such as a car, motorcycle, boat, airplane, or truck. Alternatively, the vehicle may be a non-motorized vehicle such as a bicycle. Further, the invention may be implemented without a vehicle and can be applied to a person such as a runner or walker.

A web server 116 may be utilized to communicate with any of the computing devices illustrated in FIG. 1. Details of the structure and operation of the web server 116 are explained below. However as a brief overview, the web server 116 may be utilized to receive uploaded GPS data and to generate display information in order to display a path or route of the GPS device, its antenna, and/or its associated vehicle.

There is a database server 118 which may be utilized to store relevant information in a database, such as information regarding the user, the vehicle of the user, lap times, etc. Further information of the database server 118 is set forth below. There is also a file server 114 which may be utilized to store GPS files from the computing device 104 and its associated GPS device 102, and the mobile device 106. GPS files may be preferably stored in a file format, as opposed to a database format, although either may be used with this invention. Further, while three servers 116, 118, and 120 are illustrated, the functionality of these servers may be implemented using only one or two servers, if desired, or using four or more servers, if desired. The servers 116, 118, and 120 may utilize firewalls in order to keep the information therein secure.

The various devices illustrated in FIG. 1 are connected by a network 112. This network may be implemented using the Internet, a Wide Area Network, a Local Area Network, a VPN, and/or any other desired computer network or combinations of these networks.

Figure 2:
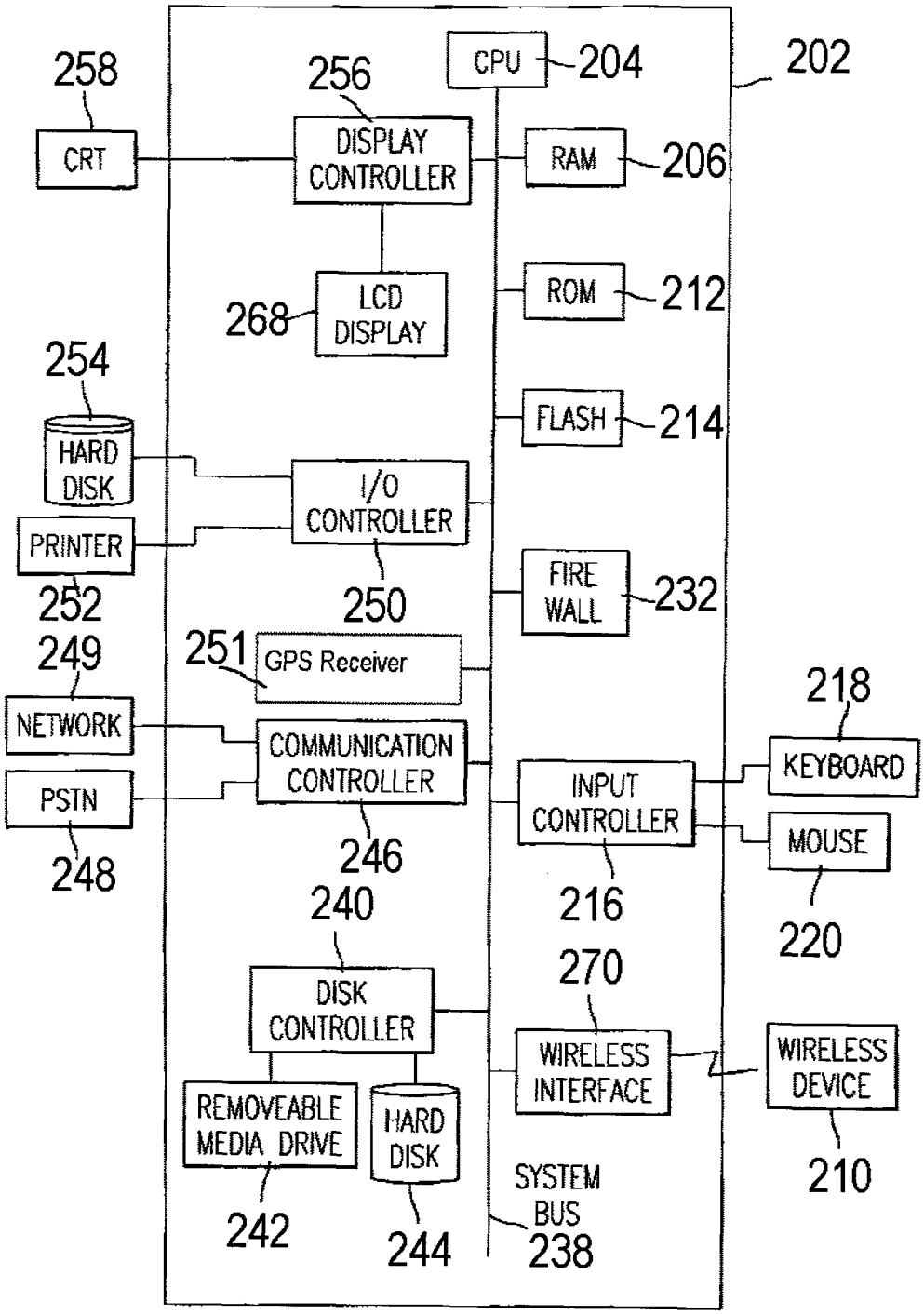
FIG. 2 illustrates a device which may be utilized to implement a computing or GPS device of the present invention.

The various computers, GPS devices, users, services, and servers utilized by the present invention including those illustrated in FIG. 1 may be implemented as illustrated in the block diagram of FIG. 2. Any element unnecessary or optional which is illustrated in FIG. 2 may be omitted from the actual implementation. In FIG. 2, a computer 202 includes a CPU 204 which may be implemented as any type of processor including commercially available microprocessors from companies such as Intel, AMD, Motorola, Hitachi, Qualcomm, Samsung and NEC, for example. There is a working memory such as a RAM 206, and a wireless interface 208 which communicates with a wireless device 210. The communication between the interface 208 and device 210 may use any wireless medium (e.g., radio waves or light waves). The radio waves may be implemented using a spread spectrum technique such as Code Division Multiple Access (CDA) communication or using a frequency hopping technique such as that disclosed in the Bluetooth specification.

There is a ROM 212 and a flash memory 214, although any other type of non-volatile memory (e.g., EPROM, or an EEPROM) may be utilized in addition to or in place of the flash memory 214. An input controller 216 has connected thereto a keyboard 218 and a mouse 220. There are serial and parallel interfaces (not shown) connected to serial and parallel devices (not shown). There is an IEEE 1394 device, commonly referred to as a fire wall device 232, connected to an IEEE 1394 interface (not shown). The computer 202 may also include a USB port and an Ethernet network connection.

The various elements of the computer 202 are connected by a system bus 238. A disk controller 240 is connected to a removable drive 242 which may read and includes therein any type of removable storage media such as a flash memory card, a USB drive, an optical disc such as CD or DVD, and a hard disk drive 244. A hard disk 244 is connected to the bus 238. A communication controller 246 allows the computer 202 to communicate with other computers (e.g., by sending e-mail messages) over a telephone line 248 or a network. An I/O (Input/Output) controller 250 is connected to a printer 252 and a hard disk 254, for example using a SCSI (Small Computer System Interface) or a PCI bus. A GPS receiver may be implemented as any type or desired GPS device and includes a GPS antenna which is either internal to or external to the computer 202. There is also a display controller 256 connected to a CRT (Cathode Ray Tube) 258, although any other type of display may be used including a liquid crystal display 268, a light emitting diode display, a plasma display, etc.

Figure 3:
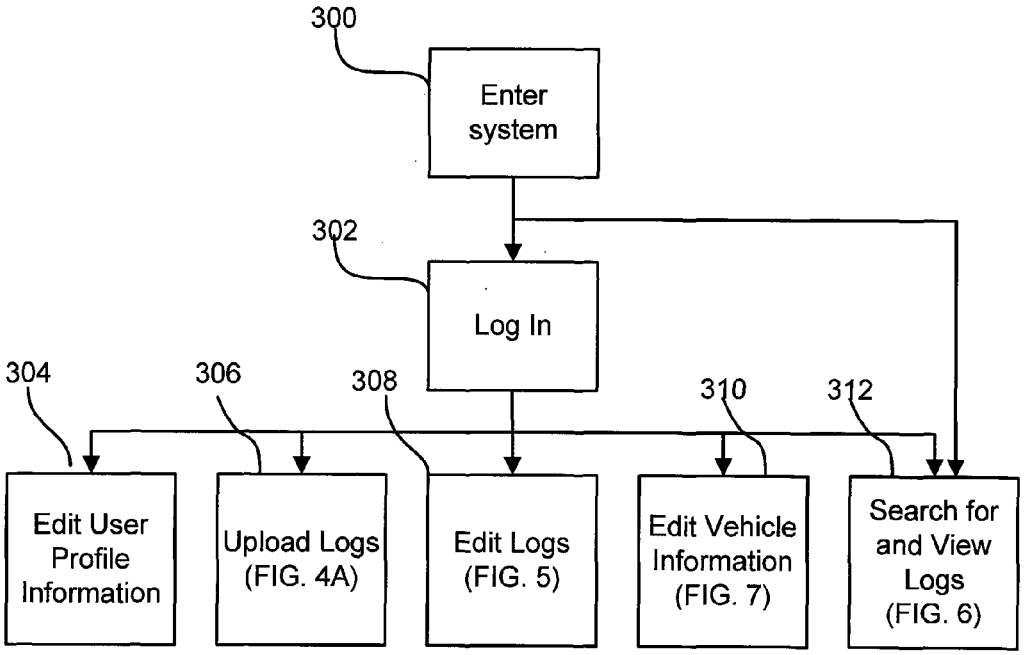
FIG. 3 is a system navigation diagram which provides a high level overview of the various modules which may be useable with the present invention.

FIG. 3 is a system navigation diagram showing the flow and modules which may be utilized with the present invention. The various blocks illustrated in FIG. 3 are preferably implemented using software executing on one or more of the computing devices disclosed herein. When starting in block 300, the user first enters the system. This can be performed by, for example, navigating to the appropriate web address or URL, or starting an application on a mobile device. According to one embodiment of the invention, the user then logs in at block 302. The logging in may be performed by the user entering a user ID and a password, for example. Any other desired type of login is possible and this may be performed by alternative manners such as fingerprint recognition, retina scan, or using a generalized login which may be utilized with different applications, for example a login with a Google or Gmail ID.

Once the user has logged in in block 302, the user may then perform any of the functions illustrated in the bottom row of FIG. 3. For example, in step 304, the user edits his or her profile information. The profile information may include any desired information of the user, such as a picture, favorite racetrack, experience level, password, username, etc.

Block 306 illustrates the option of uploading logs or GPS data files which include both GPS information and other information obtained from the vehicle which may be logged, such as speed, acceleration information, throttle position, braking information, or any other desired information. A detailed review of the uploading process is set forth with respect to the flowchart of FIG. 4A which utilizes the processes illustrated in FIGS. 4B and 5.

Figure 5:
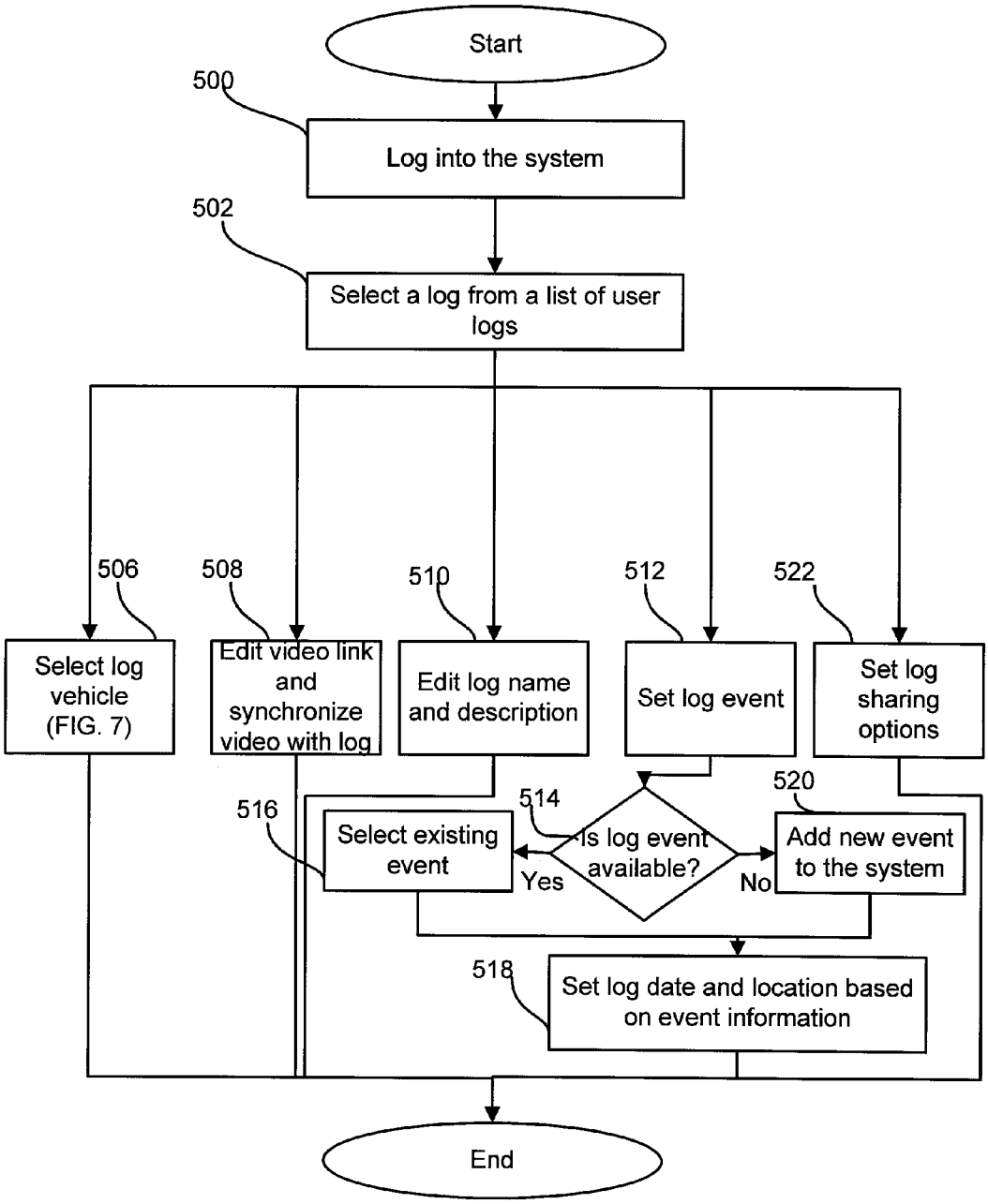
FIG. 5 is a flowchart which illustrates how to edit logs and information obtained from a user.

In block 308, the user has the functionality to edit the logs. The details of the editing of the logs are illustrated in the flowchart of FIG. 5 and described below. Exemplary editing which can be performed includes synchronizing the logged data with video, setting of sharing options, and other features described below.

In block 310, the user has the ability to edit information of the vehicle. This process is explained below with respect to the flowchart of FIG. 7 and may include adding a new vehicle, and setting the vehicle the name, description, and picture, for example.

Figure 6:
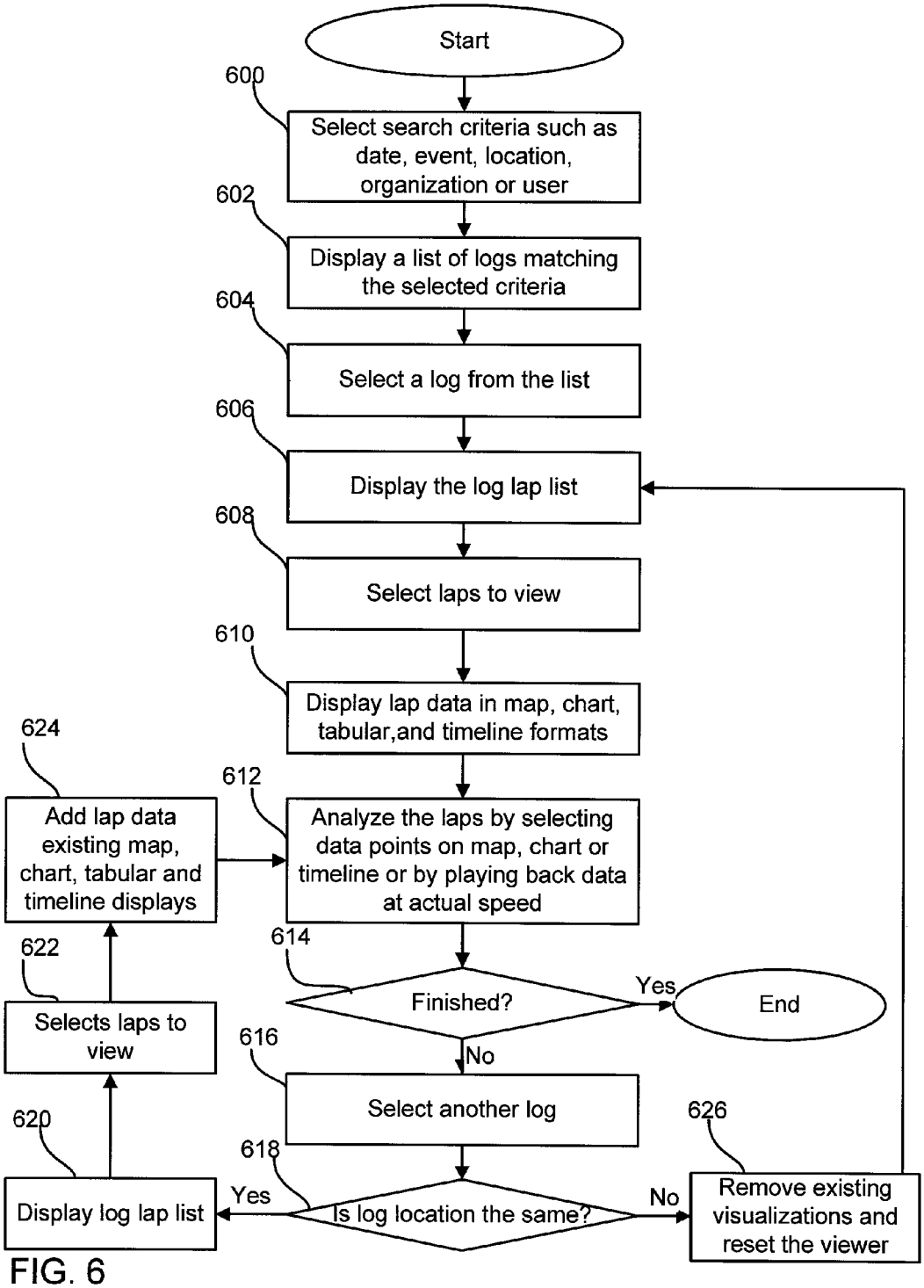
FIG. 6 is a flowchart utilized to search for and view logs.

Block 312 illustrates a module which allows a user to search for and view logs or log information. Details of this process are illustrated in the flowchart of FIG. 6. This module allows specific users, locations, dates, events, organizations, etc. to be searched. Further, criteria may be selected as to what is viewed. The module of block 312 according to one embodiment is accessed only after the user logs in. However, according to an alternative embodiment, the user may be given an option to search and view logs as set forth in FIG. 6 without having an account or logging in, if the appropriate permissions are set for the various log files for public viewing.

Figure 4A:
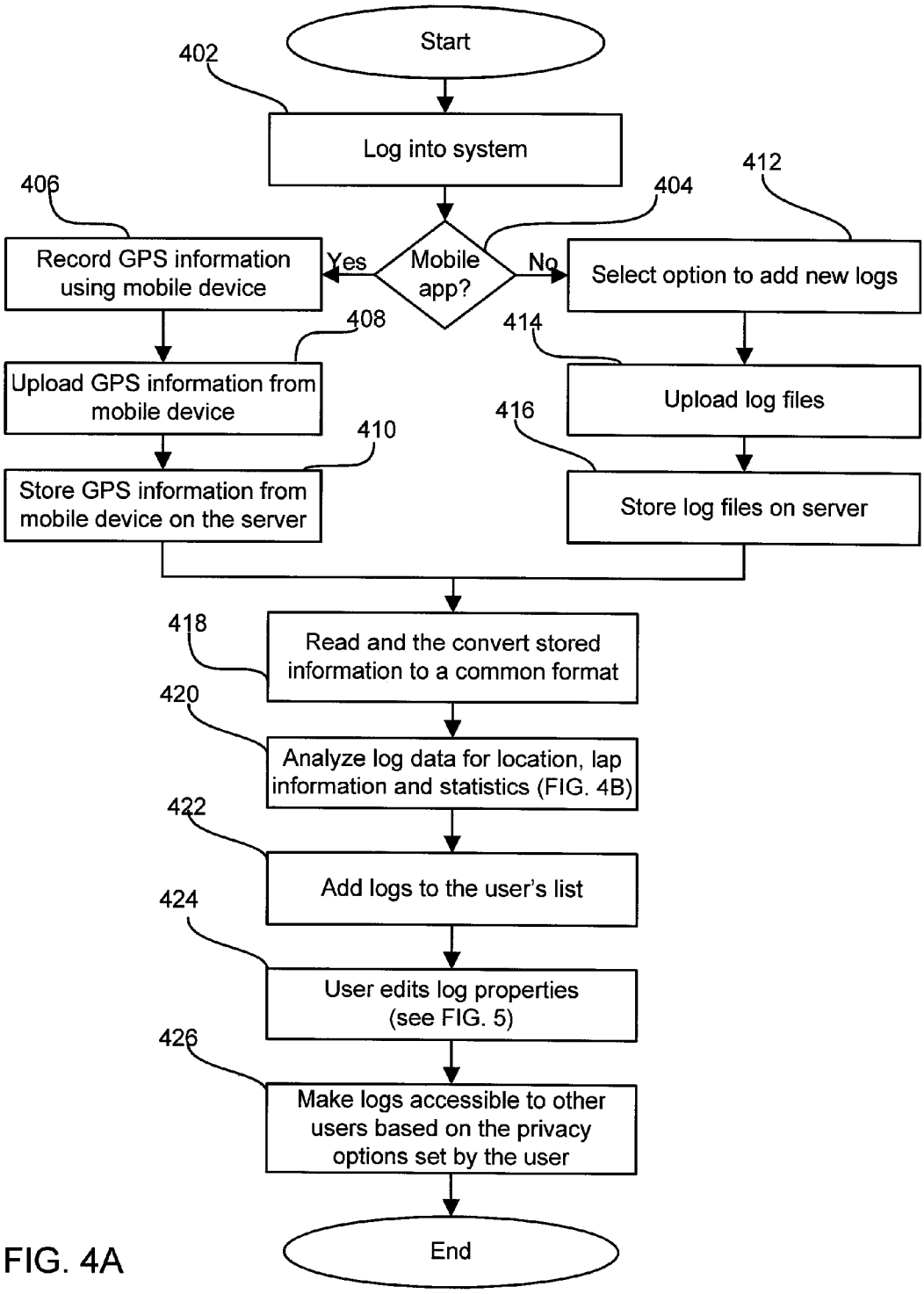
FIG. 4A is a flowchart which illustrates a process of uploading a GPS log.

FIG. 4A is a flowchart utilized for uploading logs or data into the system for later viewing or playback. The flowchart of FIG. 4A also allows for the normalization of data in step 420 which is explained in detail with respect to FIG. 4B, and the editing of log properties and logs which is illustrated in detail with respect to FIG. 5.

After starting, in step 402, the user logs into the system. This may be accomplished by entering a user ID and password. Alternatively, a biometric verification may be performed such as a retina scan, fingerprint scan, or facial recognition system. Alternatively, a universal ID which is used for different applications may be utilized such as a Gmail address, Google ID, or an Apple ID. Step 404 examines whether there is a mobile application or app, or a mobile device which will be doing the upload. If there is no mobile app or device, flow proceeds to step 412 for a manual upload. The manual uploading process may be performed by removing a memory card such as a SD memory card or a micro SD memory card storing one or more log files from the GPS device and inserting it into a card reader of a computer such as the computing device 104 of FIG. 1. Alternatively, the GPS device or logging device may be connected by a cable or wirelessly to a computer which is doing the uploading. Any type of wired connection including a USB connection, Ethernet connection, or other desired wired connection may be utilized. For the wireless transmission, any desired wireless method may be utilized including a Bluetooth protocol, or a wireless networking protocol such as one of the 802.11 standards, for example.

According to an embodiment of the invention, the uploading and selection of files may be performed using a web browser executing on a computing device such as 104. Alternatively, a dedicated program may be running on the computing device 104 to perform the uploading. In step 412, the user selects an option to add or upload new logs. Preferably, the user will identify the specific file or log which is to be uploaded. Just one log file or a plurality of log files may be uploaded, as desired. In step 414, the user preferably clicks an icon or button on the screen or user interface of the uploading device and the selected logs are uploaded. Alternatively, the user can drag and drop a file to a specific area of the screen and it will be automatically uploaded. In step 416, the uploaded logs are stored on a file server, such as the file server 120 illustrated in FIG. 1, for example. Alternatively, the uploaded logs may be stored on the server 116 and/or the server 118.

If step 404 determines that there is a mobile application or program running, or the device at issue is a mobile device, flow proceeds to step 406. In step 406, the log or log file is created by recording GPS information using the mobile device, such as the mobile device 106 illustrated in FIG. 1. In this case, the recorded information includes GPS information but may also include other data which is logged, such as speed or acceleration information, such as acceleration information of three different axes including axes in the x, y, and z direction. After the information is recorded in step 406, the recorded GPS information is uploaded by the mobile device in step 408.

The uploaded GPS information from the mobile device 408 may be uploaded automatically and without user intervention. The GPS information may be automatically uploaded as the vehicle is moving and the data is being recorded. This will allow a display outside of the vehicle, for example in a spectator area, of the GPS information, including lap times, if desired, as the vehicle is moving and GPS is being recorded. If there is no connection to the network 112 or any wireless network, the GPS information is stored until a connection is established, and then it is uploaded. According to an alternative embodiment, the GPS information is uploaded when the vehicle returns to a parking place or location, such as the paddock, or a specific place within the paddock. The automatic upload may alternatively occur when the GPS information indicates that the vehicle has left the racetrack and/or has left the pit area. Still further, the automatic upload can occur when the mobile device utilizing the GPS receiver included therein detects that the vehicle is stationary for a predetermined time, such as 20 seconds, 30 seconds, 45 seconds, 1 minute, 2 minutes, or any other desired time period. The user may set the parameters which cause the automatic upload to occur.

As an alternative to or in addition to the automatic upload in step 408, the upload may be caused manually by the user of the GPS device or logger device. For example, when the user is done recording, the user may manually select an upload option which causes the upload to occur.

The uploading of step 408 may take place using a mobile phone network, such as a 4 G-LTE network, a 3 G system, or any other mobile phone network. The device conveniently would be a mobile Smartphone with a GPS recording function and a mobile app or app running on the Smartphone would perform the uploading function using the built-in communication functions of the mobile phone. Such a system would provide a very inexpensive hardware solution to the user as the user may already have such a mobile phone with GPS and communication capabilities built in. Alternatively, the mobile device may perform the uploading using a computer network which is utilizing an 802.11 wireless communication standard or any other wireless standard, or any other type of upload from the mobile device, including connecting the mobile device to another computing device which has communication capabilities, or connecting a cellular data modem to the mobile device.

Regardless of the mobile device and the manner used to upload the GPS information or the log files, the uploaded GPS information, log files, or other data received from the mobile device are stored on a server such as the file server 120 illustrated in FIG. 1. Alternatively, the server 116 and/or server 118 or any other desired server may be utilized to store the uploaded information.

From steps 410 and 416, flow proceeds to step 418. In step 418, the log is read and the stored information is converted to a common format. Different data loggers, GPS devices, and other recording devices or computer devices may store data in different formats and the invention includes converting this information to a common format. The present invention preferably uses a single format for storing GPS data from any type of GPS device, although according to an alternative embodiment, multiple formats can be used. An exemplary common format which may be utilized by the present invention is set forth in the data structure 900 illustrated in FIG. 9A, explained in detail below. The common format may also include additional data such as additional parameters which are logged by the GPS device or data logger within a vehicle. The conversion can be performed by knowing where the appropriate data fields are located in the source or incoming log file, and rearranging the data or fields to correspond to the common format, such as the format illustrated in FIG. 9A.

Next, in step 420, the log data is analyzed in order to determine laps, location, statistics, and other information. Details of step 420 are also set forth in FIG. 4B. Flow proceeds to step 422 in which the logs are added to the user's list of logs, or otherwise associated with the user who uploaded the logs. In step 424, the user is permitted to edit the properties of the log. For example, the properties include the name, description, event data, possibly video synchronization, and other factors. Details of the editing of these properties are set forth with respect to the flowchart of FIG. 5.

In step 426, the logs are made accessible to other users depending upon the privacy options set by the user. For example, the user may allow everyone to utilize the GPS logs, no one but that specific user to have access to the logs, specifically invited or selected friends or colleagues, or a circle or group of friends may have access to the data. In this way, a racer may give his good friend information of his best driving laps, but competitors of that racer will not have access to such data. Further, this may be useful for teaching how to drive fast, and expert drivers who record fast lap times or have great driving techniques may give access to their lap information only to specific people or customers, or others who have paid appropriate compensation. The process of FIG. 4A then ends.

Figure 4B:
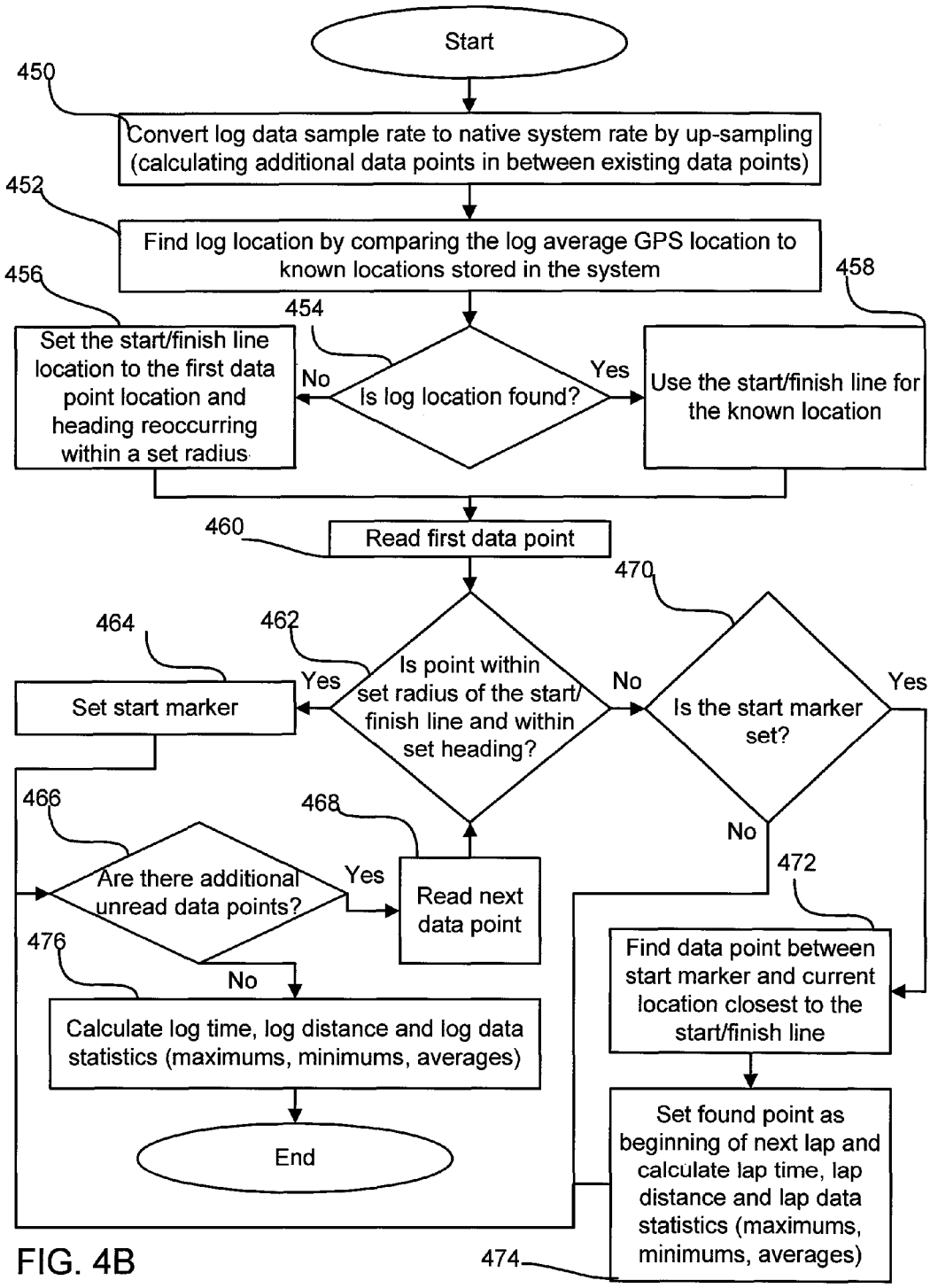
FIG. 4B is a flowchart of a process utilized to normalize GPS data.

FIG. 4B illustrates a process to normalize the uploaded GPS data which may include, if desired, converting the stored information to a common format, re-sampling which may be up-sampling or down-sampling of the data rate, and/or processing the information in order to determine what constitutes entire laps which may be shared and compared, for example. In FIG. 4B, after starting, step 450 converts the log data sample rate to a native sample rate by up-sampling which is calculating additional data points in between existing data points, for example. Data loggers may have different GPS sampling rates. For example, suppose the fastest GPS sampling rate for a GPS system or logger is 10 Hz or Hertz, which means that the GPS data is sampled at 10 times per second. Suppose another GPS device samples at 5 Hz. In this case, the sampling rate is half of the 10 Hertz sampling rate so the 5 Hertz signal would be converted to a 10 Hertz signal by interpolating or averaging, for example, data points between the actual 5 Hertz data points which have been captured. Of course, the same principles can be applied to a 4 Hz signal, a 2.5 Hz signal, etc. If the sampling rate of the present invention is set to 10 Hz and technology improves such that there exists a 15 Hz signal in the future, it is also possible to down-sample the GPS data to fit into the common format which was selected for use by the system, or to modify the stored data for all loggers to have a 15 Hz sampling rate.

Next, step 452 finds a location of where the GPS data or signal was captured. This is done, for example, in order to attempt to automatically determine which racetrack, geographic location, lake, parking lot, or other location was the location where the data was captured. According to one embodiment, the data in the GPS file may be averaged which approximates a central region of the captured GPS data and this average can be compared to other locations or averages which are stored in the system. If the location is known and the racetrack has previously been used (Yes in step 454), flow proceeds to step 458 in which the system uses the start/finish line for the track or competition course which is already known. If the GPS location is unknown and the GPS location or log location is not found (No in step 454), flow proceeds to step 456 which creates a start/finish line for the competition course. According to one embodiment, the start/finish line is set to the first data point where the location and heading occurs within a certain radius. This will not necessarily be the official start/finish line of the competition course but it may be close. As an alternative, the actual start/finish line of the competition course can be manually set, or otherwise determined, entered, or stored. From steps 456 and 458, flow proceeds to a process in which laps are determined from the GPS data.

According to the present invention, it is desired to compare laps of different users or vehicles and in order to have a meaningful comparison, the laps preferably have the same path (e.g., circuit) and/or the same start/finish point. However, as the GPS data is continuously and sequentially collected, a process is utilized to determine where this GPS data crosses the start/finish line and is considered a complete lap. In step 460, a first data point of a file is read. As this is the first point, a start marker is not set. Step 462 determines if this data point is within a predetermined radius of the start/finish line and if desired, within a predetermined heading and direction. For example, if the asphalt surface of a competition course or racetrack is 40 feet wide at the start/finish line, the radius may be set to 30 feet which would give a circle with a 60-foot diameter, allowing the vehicle or GPS receiver to be 10 feet off of the racetrack surface in either direction and still count as a lap. When the point at issue is determined to be within the radius of a circle at the start/finish line and within a predetermined heading (e.g., the vehicle is traveling in a proper direction across the start/finish line), flow proceeds from step 462 to step 464 which sets a start marker or flag, indicating that the processed point is within the circle. From step 464, flow proceeds to step 466 which determines if there are additional unread data points in the file. If there are additional data points, step 468 reads the next data point and flow proceeds back to step 462. If there are no additional unread data points determined to exist in step 466, flow proceeds to step 476 which calculates a log time, log distance, and log data statistics including maximums, minimums, and averages for a parameter such as speed, and any other desired parameters such as acceleration, RPMs, or other parameters which have been logged. From step 476, the process ends.

If step 462 determines that the point being analyzed is not within the start/finish line, flow proceeds from step 462 to step 470 which determines if the start marker is set. If the previously analyzed point is within the radius, the start marker will be set and flow proceeds from step 470 to step 472. In this case, the point which was just analyzed is the first point which is outside of the circle and in step 472, the point closest to the start/finish line is determined by analyzing each point within the circle. The distance of those points to the center of the start/finish line is determined, and the point that is the closest to the center of the start/finish line is the start of the lap. From step 472, flow proceeds to step 474 which sets the current point which is the first point outside of the circle as the beginning of the next lap, and the lap time of the previous lap, distance, and lap data statistics such as maximums, minimums, and averages is calculated. As this is the first data point of the next lap, the point is not within the radius of the start/finish line so the set marker is reset so that it is no longer set. From step 474, flow proceeds to step 466 which determines if there are additional unread data points in the GPS file which is being analyzed.

If step 470 determines that the start marker is not set, flow proceeds from step 470 to step 466.

This process continues utilizing steps 462 through 466 until step 466 determines that there are no additional data points which are unread. Flow then proceeds to step 476 to calculate the log time, log distance, and log data statistics such as the maximum, minimums, and averages, and the process then ends.

FIG. 5 illustrates a flowchart which is utilized to edit and/or describe features of log information. After starting, the user logs into the system in step 500, or alternatively may already be logged into the system. In step 502, the user selects a log from a list of logs associated with that user. This log may be selected by searching for a particular log, scrolling through or scanning the logs, or in any desired manner. When the log is selected, flow can proceed to any of the steps 506, 508, 510, 512, and 522, as desired by the user. The user may be selected with an option for each of the types of editing performed, or may sequentially go through an editing process for the various information.

Figure 7:
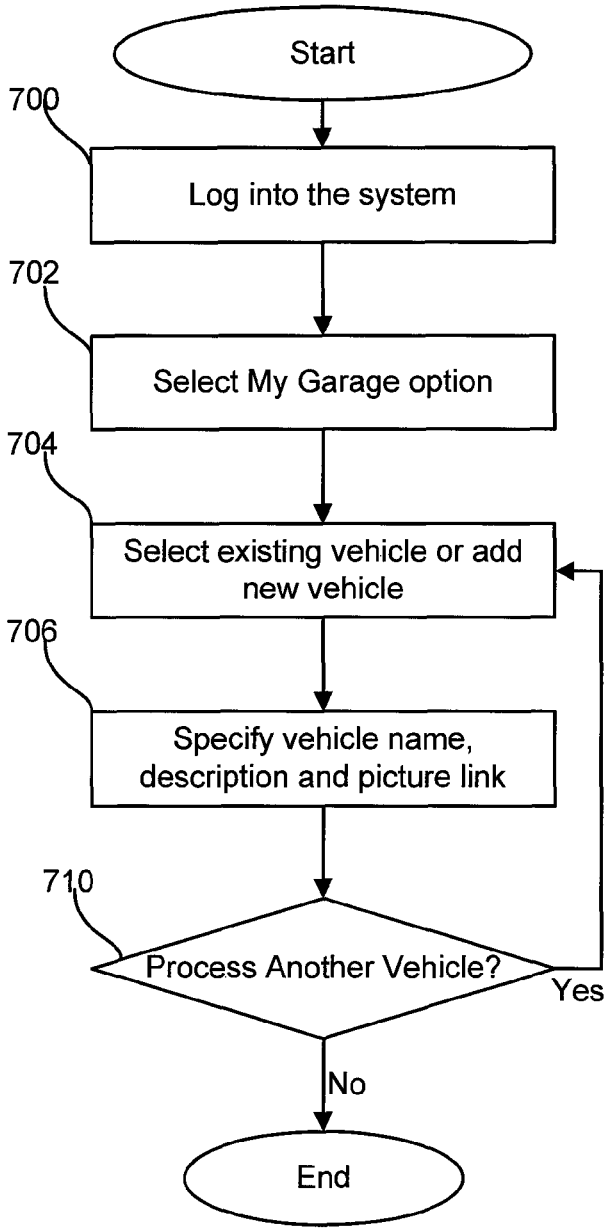
FIG. 7 is a flowchart utilized to edit vehicle information.

In step 506, the user selects a vehicle associated with the log, the details of which are described with respect to FIG. 7. If desired, the user may associate video with the GPS log, as shown in step 508. The video may already be uploaded, for example to the external video service 114 illustrated in FIG. 1, or from any other video source. The user can select the link or URL to the video, and will synchronize the video with the log. According to one embodiment, the video is manually reviewed by a user and when the vehicle is at the start/finish line, or other known location, it can be indicated that the video is at a certain lap number at the start/finish line and then synchronized in time with the GPS position. Therefore, it is possible to advance the GPS data and position within the GPS file in coordination with the advancing of the video. Alternatively, the video may be automatically synchronized with the log based on time stamps of other features of the recording and GPS/data logging system.

As another option, from step 502, flow proceeds to step 510 which allows the user to edit the log name and description. For example, the user can indicate by the name which is chosen or assigned that the log contains the best lap of that user, was made under certain weather conditions, was made using certain tires or certain fuel in the vehicle, or any other description.

In step 512, the user may set an event which is associated with the log. For example, if the log was obtained during a specific race or during a specific Driver Education event on a racetrack, step 514 determines whether this event already exists and is available. If the event already exists (Yes in step 514), the existing event is selected in step 516. This is done in order to classify, label, associate, or identify the same event which is run by different users so that the users can more easily find and compare their GPS log information. If step 514 determines that the log event is not available (No in step 514), flow proceeds to step 520 which adds a new event to the system. From steps 520 and 516, flow proceeds to step 518 in which the log date and location are set based on the event information.

When the log is selected in step 502, the user may set the log sharing options in step 522. In step 522, the user may indicate that the file is private and no one can look at it, that specifically identified people are permitted to look at it, that the log is public and anyone can look at it, or a specific group is permitted to view the log data or its visualization. This allows friendly people or friends to learn from your logged GPS data, and can be used to prohibit competitors from using your secrets or skills against you on the racetrack. The process of FIG. 5 then ends.

FIG. 6 is a flowchart illustrating a process used to search for and view logs. After starting, step 600 allows a user to specify search criteria such as a date, event, location, organization, or user, for example. A list of logs matching the selected or entered search criteria is displayed in step 602. The user then selects a log from the list of displayed search results.

After the log is selected in step 604, step 606 displays the laps which are contained within the log. For example, depending upon the size of the track and the duration of the run or GPS log, there can be a varying number of completed laps, for example, from as few as one or a few laps, to hundreds of laps for a longer event such as an enduro, a 12-hour race, or a 24-hour race. In step 608, the user selects the laps which are to be reviewed.

In step 610, lap data is displayed in a map, a chart, tabular, and/or timeline formats. According to an embodiment, the process of FIG. 6 is performed by a user utilizing a web browser, for example, at the device 108 illustrated in FIG. 1 and is interfacing with the various servers and services illustrated in FIG. 1 including the web server 116, the file server 120, the database server 113, and/or the external map service 110.

The map server sends a library of code to the user's browser to allow the browser to communicate with the map server. The user's browser then gets the information about the data to be displayed from the web server 116 of FIG. 1. This includes, for example, coordinates of all the points, colors, labels, etc. The browser, using the code library, requests a map from the map server that covers the area of all the points. The map server then returns the map and the code library, draws this map, and overlays the data on top of it. According to one embodiment, only the map image and the code library is requested and retrieved from the map server, although additional or alternate data, code, or information may be obtained according to an alternate embodiment. The lap data points originate from the web server 116 and are transmitted to the web browser of a user. In the browser, the map is drawn and the data is overlayed, without the data points being sent to the map server. When the location being displayed changes (either through playback, the user dragging the map around or selecting a datapoint) causes another call to the map server to retrieve additional parts of the map image that are not in browser cache.

From step 610, flow proceeds to step 612 which allows the analysis of the laps by selecting data points on the map, chart, or timeline, or by playing back the data in real time. In this context, playing back the data in real time does not mean that it is live, but means that the visualization and the indication of location are moving, as the time or distance on the track is increasing or changing. Real time may also be interpreted to mean at the same speed it was recorded. Further, the playback can be accelerated or slowed down as desired by the user. An example of how information is displayed and played back is set forth in FIG. 8 which is described below.

Step 614 then determines if the display and analysis is finished. If the display and analysis is finished, the process then ends. If the process is not finished, flow proceeds to step 616 which allows the user to select another log.

From step 616, flow proceeds to step 618 which determines whether the location of this newly selected log is the same as the previous log. If the location is not the same, a different track map will be utilized and flow proceeds to step 626 which removes existing visualizations and resets the viewer for display of a new location. From step 626, flow proceeds back to step 606. If step 618 determines that the log location is the same, flow proceeds from step 618 to step 620 which displays the lap list of the newly selected log. In step 622, the user then selects the laps to view, and in step 624, the selected laps and corresponding data are added to the existing map, the chart, and the tabular and timeline displays. From step 624, flow proceeds back to step 612.

FIG. 7 illustrates a flowchart utilized to edit vehicle information, the vehicle being used to capture the GPS log data using a logger, GPS device, mobile phone, etc. attached to the vehicle, or within the vehicle. After starting, flow proceeds to step 700 where the user logs into the system. In step 702, the user selects the My Garage option which allows the user to edit which vehicles are to be associated with the log data. Step 704 then allows the user to select an existing vehicle or to add a new vehicle. In step 706, the vehicle can be named, a description added, and a picture linked or associated with the vehicle. Flow then proceeds to step 710 which allows the processing of another vehicle. If the user desires to process another vehicle (Yes in step 710), flow proceeds to step 704. Alternatively, if another vehicle is not desired to be processed (No in step 710), the process of FIG. 7 ends.

Figure 8:
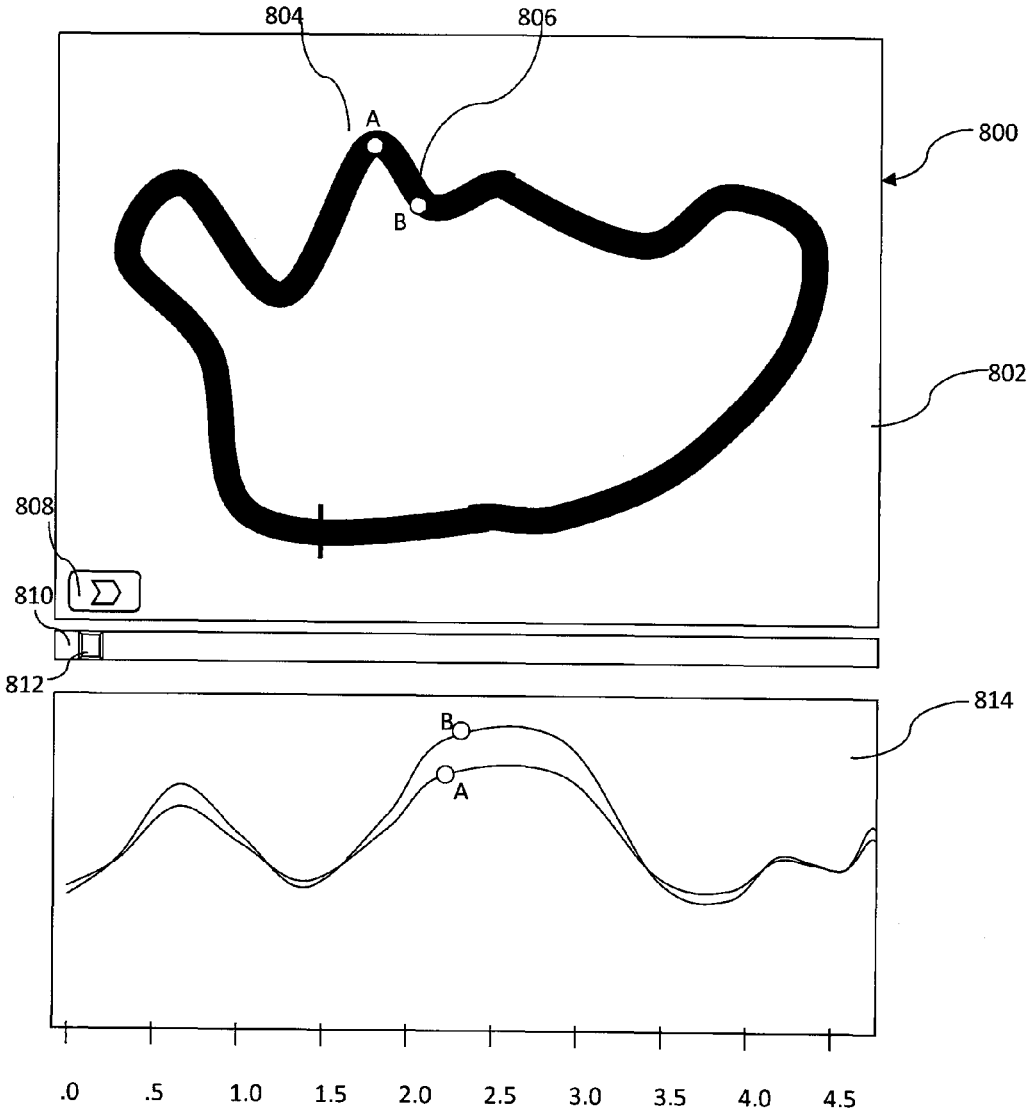
FIG. 8 is an exemplary screen shot of viewing two vehicles on a closed loop circuit.

FIG. 8 is an exemplary screen shot 800 of vehicles A 804 and B 806 on a single lap of a closed loop circuit. The upper section 802 of the screen shot 800 is a graphical map of the circuit having a start/finish line located at the bottom left portion of the circuit. There is a play button 808 which when clicked on or selected advances the vehicles A and B on the map over time. As time increases, the slider 812 on the slider bar 810 advances to the right. According to one embodiment, vehicles A and B leave the start/finish line at the same time when the play button 808 is pressed. If one vehicle travels faster than the other, that vehicle will advance faster and/or farther on the map as time increases during playback. This allows a user to quickly visualize where his vehicle is faster and slower than the other vehicle being displayed.

The bottom portion of the screen display 800 illustrates a chart 814 which, for example, displays the speed of vehicles A and B on the vertical axis as compared to the horizontal axis which may be implemented as time or distance. The chart 814 has points A and B which represent the vehicles advancing in synchronism with the positions of the vehicle A and B shown in the upper section 802. The user has the ability to control the speed of advancement so that one lap may be played in a time faster than the actual time, slower than the actual lap time, or at the actual lap duration, also called real time.

Another feature of the invention is the ability to reset the relative positions of vehicles A and B on a lap. For example, if vehicle A is much faster than vehicle B at a certain portion, halfway through the lap the vehicles A and B may be separated too much to be able to visually realize the relative speed of the two vehicles through the same corner. Therefore, instead of having A and B all synchronized to the same position at the start/finish line, the user may drag or otherwise cause vehicles A and B to be at the same position on the track away from the start/finish line in order to compare the relative speeds of vehicles A and B through corners and sections of the circuit relative to the new position where vehicles A and B are set at the same place.

FIG. 9A illustrates a data structure 900 utilized to store GPS and other relevant information. Each manufacturer of GPS logging devices utilizes its own proprietary file format for storing GPS data. According to the present invention, for example in step 418 of FIG. 4A, the uploaded or received logs are converted to a common format. This format may be implemented in the exemplary format illustrated in FIG. 9A, although other formats, arrangements of the data, additional fields, or the omission of fields are possible.

The first field in the data structure 900 of FIG. 9A is the LogID 902. A unique identification may be assigned to each file uploaded, and this identification of the log file is stored in the field 902. Note that as the LogID is the same for each entry in the file, it may be possible to structure the file without repeating the LogID for each entry or record in the file. The second entry in the data structure 900 is a TimeStamp 904. The TimeStamp 904 corresponds to the time at which the GPS position is sampled. There are fields 906, 908, and 910 corresponding to the Longitude, Latitude, and Altitude obtained from the log containing the GPS sampling.

A field Heading 912 indicates the heading or direction in which the GPS receiver, antenna, and/or vehicle is traveling at the time of the GPS sampling. A field Speed 914 indicates the speed of the GPS device, GPS antenna, and/or vehicle.

A field Lap 916 preferably corresponds to an integer number corresponding to the lap number of the vehicle. Note that the first completed lap is preferably numbered as lap one. The GPS data which is captured before that first lap such as the time traveling through the pit or paddock or on the racetrack before the start/finish line may be labeled as lap zero, for example. A field LapDist 918 signifies the distance traveled for the lap at issue. This will allow the playing back of laps from different vehicles or different times and aligning the data to match at a certain distance. For example, if there is a desire to start the vehicles at a same position or same corner midway through the lap in order to have a graphical playback, this field can be read and the positions of the displayed vehicles set to be equal to each other. A field TotalDist 920 is utilized to store the total distance traveled from the start of the recording of the GPS information.

For each GPS file or log file which is uploaded, information is associated with that file, as illustrated in data structure 922 of FIG. 9B. In the data structure 922, a field LogID 924 signifies a unique identification which is assigned to the log file, and the information in this field may correspond to the LogID 902 of the data structure 900 in FIG. 9A. There is a field UserID 926 which stores a unique identification of the user who uploaded or who should be associated with the log file.

When a person records information at a specific event on the racetrack, circuit, or other event, a specific ID is associated with that event in order to store and readily recall data from that specific event, and such information is stored in a field UserEventID 928.

In order to users to be able to compare GPS information and other log information captured at different times, days, events, etc., there is a field LocationID 930 which is utilized to store a unique location associated with the place where the vehicle was running when the GPS information is obtained. This LocationID 930 is typically associated with the name of a track, circuit, or course.

There is a field called LogName 932 which is utilized to provide a name, such as a user described name to the log file, as described with respect to step 510. Similarly, a field LogDesc 934 is utilized to store a description of the log, also as explained with respect to step 510 of FIG. 5.

A field VehicleID 936 is utilized to store an identification of the vehicle which was utilized to generate the log, and the VehicleID 936 may be selected in step 506 of FIG. 5. A field Share 938 is utilized to store the sharing options of the log file, as explained with respect to step 522 of FIG. 5. The sharing options may allow the user to not share the file with anybody, to make the file available to everybody, to limit the sharing to specific users, or groups, or to share or not share in any desired manner.

A field VideoLink 940 stores location information of where a video file associated with the log file is stored, and may include a file name and/or address or location information. The video may be stored on a separate external video service 114, or may be stored on the web server 116 or other location. There is also a FileName 942 which may be utilized to store the file name of the log file, for example, when the log file is stored on the file server 120. Further, the file name may also include a path or location information of where the file is stored.

FIG. 9C illustrates a data structure 942 used for storing information of each lap of a log file, meaning there is information corresponding to the data structure 942 for each lap of a log file that is uploaded. In the data structure 942, there is a LogID 944 which is an identification of the log file which corresponds to the fields 924 of the data structure 922 of FIG. 9B and the field 902 of the data structure 900 of FIG. 9A. A field LapNum 946 stores a number of the lap, a field LapStart 948 stores a position or index of the start of the lap, and a LapEnd field 950 indicates a time at which the lap ends.

The data structure 942 further includes a LapTime field 952 which stores a total time of a lap, and a field LapLength 954 stores the total length or distance of the lap. A field LapTypeID 956 indicates information of the type of the lap, for example whether it is a full lap, meaning that a start and end of the lap at the start/finish line was recorded, whether it was a warm-up, which is anything before the first full lap, or a cool down, which is anything after the last full lap. According to an embodiment of the invention, only full laps are shared and warm up laps and cool down laps are preferably visible only to the owner of the log. This will allow a parking position in a parking lot or paddock to be kept hidden from people other than the owner of the log from knowing where the owner is parked. If the log is not of a closed circuit, but for example on an auto-cross course, according to an embodiment, there will be no records in the table 942 and the whole log will be shareable.

The present invention is preferably implemented utilizing software code executed on one or more processors or processing devices as explained above. The software can be implemented using known coding techniques based on the teachings described herein. The software may be stored in one or more memories such as a RAM, ROM, flash memory, SD card, micro SD card, built-in memory, a nonvolatile memory, or volatile memory. The software may additionally or alternatively be stored on a hard disk, flash drive, or optical disk, for example.

Further, different software modules of the invention may be stored on different memories which are utilized by a single system. For example, there may be a first computer readable medium which is stored in a mobile device and/or executed by a mobile device, and a second computer readable media hosted in a web server, such as the server 116. Further, there may even be a third computer readable medium which is utilized to generate a display, and may be stored in, for example, the device 108 of FIG. 1, and/or the devices 104 and/or 106 of FIG. 1.

The present invention is a combination of software and hardware and cannot be considered to be software per se but includes a computer readable medium which may be considered a non-transitory medium, a method of executing the software, and a system or device for executing the software, for example. Further, the invention does not include, by itself, the software code represented as a transitory signal, but does include the software code embodied on a non-transitory medium.

Obviously, numerous modifications and variations of the present invention are possible in light of the above teachings. It is therefore to be understood that within the scope of the appended claims, the invention may be practiced otherwise than as specifically described herein.

The invention claimed is:

1. A method of communicating, comprising:

receiving, from a first computing device by a receiver of a server, first data containing GPS information from a first vehicle in a first format;

receiving, from a second computing device by the receiver of the server, second data containing GPS information from a second vehicle in a second format;

processing, by a processor of the server, at least one of the first and second data to obtain normalized data containing GPS information used for synchronized display of positions of the first vehicle and the second vehicle; and transmitting, by a transmitter of the server, the normalized data to a display computer for simultaneous and synchronized display of the positions of the first vehicle and the second vehicle.

2. The method according to claim 1, wherein the step of receiving from the first computing device comprises:

receiving, by the receiver, the first data from the first vehicle without the user manually transferring the first data to a computing device for upload.

3. The method according to claim 1, wherein the processing comprises:

normalizing, by the processor, a GPS sampling rate of the at least one of the first and second data.

4. The method according to claim 1, further comprising:

converting, by the processor, at least one of the first and second data to data in another format.

5. The method according to claim 1, further comprising:

transmitting, by the transmitter, map information to be displayed with the positions of the first vehicle and the second vehicle.

6. The method according to claim 5, wherein the transmitting comprises:

transmitting, by the transmitter, the normalized data which is of the first and second vehicles on a circuit without transmitting data corresponding to a location within pit or paddock areas.

7. The method according to claim 6, wherein the transmitting comprises:

transmitting, by the transmitter, the normalized data which is of only complete laps of the first and second vehicles on the circuit.

8. The method according to claim 1, further comprising:

transmitting, by the transmitter, video which was captured by a video capture device of the first vehicle to the display computer to be simultaneously displayed with the display of the positions of the first vehicle and the second vehicle.

9. The method of claim 1, further comprising:

transmitting, by the transmitter of the server, a speed of the first vehicle and a speed of the second vehicle to the display computer for synchronized display with the positions of the first vehicle and the second vehicle.

10. A system comprising a first non-transitory computer readable medium and a second non-transitory computer readable medium, the first non-transitory computer readable medium including computer code for causing a mobile computing device to communicate with a processing device of a server and which causes the mobile computing device to perform the steps of:

capturing GPS information from a first vehicle in a first format; and uploading the GPS information from the first vehicle, the second non-transitory computer readable medium including computer code which causes the server to perform the steps of:

processing, by the processing device of the server, the GPS information from the first vehicle in order to display a position of the first vehicle; and transmitting, by a transmitter of the server, the GPS information of the first vehicle which has been processed to a display computer to display a position of the first vehicle, wherein the second non-transitory computer readable medium further includes computer code for causing the processing by the processing device of the server to normalize at least one of the GPS information from the first vehicle and GPS information from a second vehicle in order to obtain GPS information used for synchronized display of positions of the first vehicle and the second vehicle; and for transmitting by the transmitter of the server the GPS information from the second vehicle in order to obtain a synchronized and simultaneous display of positions of the first vehicle and the second vehicle.

11. The system according to claim 10, wherein the first non-transitory computer readable medium is for use with a mobile phone which includes a GPS receiver.

12. The system according to claim 10, wherein the first non-transitory computer readable medium includes computer code for causing the mobile computing to automatically upload the GPS information to the server using a wireless transmitter.

13. A system for communicating, comprising:

a receiver of a server to receive from a first computing device first data containing GPS information from a first vehicle in a first format, and to receive from a second computing device second data containing GPS information from a second vehicle in a second format;

a processor of the server configured to process at least one of the first and second data to obtain normalized data containing GPS information used for synchronized display of positions of the first vehicle and the second vehicle; and a transmitter of the server to transmit the normalized data to a display computer for simultaneous and synchronized display of the positions of the first vehicle and the second vehicle.

14. The system according to claim 13, wherein:

the receiver receives the first data from the first vehicle without the user manually transferring the first data to a computing device for upload.

15. The system according to claim 13, wherein:

the processor is further configured to normalize a GPS sampling rate of the at least one of the first and second data.

16. The system according to claim 13, wherein:

the processor is further configured to convert at least one of the first and second data to data in another format.

17. The system according to claim 13, wherein:

the transmitter is further configured to transmitting map information to be displayed with the positions of the first vehicle and the second vehicle.

18. The system according to claim 17, wherein:

the processor is configured to process to obtain the normalized data such that the normalized data is of the first and second vehicles on a circuit without transmitting data corresponding to a location within pit or paddock areas.

19. The system according to claim 18, wherein:

the processor is configured to process to obtain the normalized data which is of only complete laps of the first and second vehicles on the circuit.

20. The system according to claim 13, wherein:

the transmitter of the server transmits video which was captured by a video capture device of the first vehicle to the display computer to be simultaneously displayed with the display of the positions of the first vehicle and the second vehicle.

* * * * *